US010726766B2

(12) United States Patent
Cho et al.

(10) Patent No.: US 10,726,766 B2
(45) Date of Patent: Jul. 28, 2020

(54) DISPLAY DEVICE AND INTERFACE METHOD THEREOF

(71) Applicant: LG Display Co., Ltd., Seoul (KR)

(72) Inventors: Soon-Dong Cho, Seoul (KR); Jung-Jae Kim, Paju-si (KR); Jae-Won Han, Seoul (KR); Hyung-Jin Choe, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/198,131

(22) Filed: Nov. 21, 2018

(65) Prior Publication Data

US 2019/0164470 A1 May 30, 2019

(30) Foreign Application Priority Data

Nov. 30, 2017 (KR) ..... 10-2017-0163386

(51) Int. Cl.

| | |
|---|---|
| ***G09G 3/20*** | (2006.01) |
| ***G09G 3/3266*** | (2016.01) |
| ***G09G 3/3275*** | (2016.01) |
| ***G09G 3/36*** | (2006.01) |

(52) U.S. Cl.

CPC ..... *G09G 3/2096* (2013.01); *G09G 3/2092* (2013.01); *G09G 3/3266* (2013.01); *G09G 3/3275* (2013.01); *G09G 3/3696* (2013.01); *G09G 2310/08* (2013.01); *G09G 2320/0233* (2013.01); *G09G 2320/0673* (2013.01); *G09G 2330/028* (2013.01); *G09G 2370/08* (2013.01)

(58) Field of Classification Search

CPC .. G09G 3/2096; G09G 3/3696; G09G 3/2092; G09G 3/3266; G09G 3/3275; G09G 2370/08; G09G 2310/08; G09G 2320/0673; G09G 2320/0233; G09G 2330/028

See application file for complete search history.

(56) References Cited

U.S. PATENT DOCUMENTS

| | | | | |
|---|---|---|---|---|
| 6,611,247 | B1 * | 8/2003 | Chang | G09G 5/006 345/100 |
| 8,319,758 | B2 * | 11/2012 | Kim | G09G 3/20 345/204 |
| 10,269,284 | B2 * | 4/2019 | Jung | G06F 3/0412 |
| 2002/0008682 | A1 * | 1/2002 | Park | G09G 3/20 345/87 |
| 2002/0015028 | A1 * | 2/2002 | Park | G09G 3/2011 345/204 |
| 2003/0048246 | A1 * | 3/2003 | Ham | G09G 3/3648 345/87 |
| 2003/0090614 | A1 * | 5/2003 | Kim | G09G 3/3688 349/149 |

(Continued)

*Primary Examiner* — Grant Sitta

(74) *Attorney, Agent, or Firm* — Seed IP Law Group LLP

(57) ABSTRACT

Disclosed herein are a display device capable of reducing the number of transmission lines by enabling a master circuit to perform communication with a plurality of slave circuits, which utilize different interfaces, through a common transmission line in a time divisional manner, and an interface method thereof. A timing controller uses a common transmission line of a gamma voltage generator and a level shifter which respectively utilize first and second interfaces and perform communication using the first and second interfaces in a time divisional manner.

20 Claims, 6 Drawing Sheets

(56) References Cited

U.S. PATENT DOCUMENTS

2004/0125065 A1* 7/2004 Park ..... G09G 3/20 345/92
2005/0122321 A1* 6/2005 Akai ..... G09G 3/3688 345/204
2006/0082532 A1* 4/2006 Chang ..... G09G 3/3611 345/87
2006/0227082 A1* 10/2006 Ogata ..... G09G 3/3291 345/76
2006/0238478 A1* 10/2006 Lin ..... G09G 3/20 345/98
2007/0229433 A1* 10/2007 Jang ..... G09G 3/3677 345/96
2007/0229441 A1* 10/2007 Liu ..... G09G 3/2092 345/100
2007/0268232 A1* 11/2007 Ku ..... G09G 3/3688 345/100
2008/0001894 A1* 1/2008 Oh ..... G09G 3/3677 345/98
2008/0218500 A1* 9/2008 Akai ..... G09G 3/3688 345/205
2010/0156928 A1* 6/2010 Lee ..... G09G 3/2096 345/589
2010/0164966 A1* 7/2010 Sakariya ..... G09G 3/20 345/520
2010/0253615 A1* 10/2010 Han ..... G09G 3/3426 345/102
2011/0043711 A1* 2/2011 Tsuda ..... G09G 3/3688 348/790
2011/0115771 A1* 5/2011 Cheng ..... G09G 3/3696 345/211
2011/0298761 A1* 12/2011 Seo ..... G09G 3/3677 345/204
2012/0075280 A1* 3/2012 Liu ..... G09G 3/3677 345/212
2012/0105411 A1* 5/2012 Li ..... G09G 3/3696 345/211
2013/0147775 A1* 6/2013 Hong ..... G09G 5/00 345/205
2013/0293520 A1* 11/2013 Hsiao ..... G09G 3/02 345/204
2013/0314393 A1* 11/2013 Min ..... G09G 3/36 345/212
2014/0092076 A1* 4/2014 Lee ..... G09G 3/3291 345/212
2015/0042395 A1* 2/2015 Yang ..... G09G 3/22 327/333
2015/0161927 A1* 6/2015 Hekstra ..... G09G 3/3614 345/209
2015/0213770 A1* 7/2015 Baek ..... G09G 3/3688 345/691
2015/0269900 A1* 9/2015 Iwamoto ..... G09G 3/3648 345/100
2015/0364114 A1* 12/2015 Smith ..... G09G 5/18 345/213
2016/0027390 A1* 1/2016 Kim ..... G09G 3/3607 345/694
2016/0189600 A1* 6/2016 Shin ..... G09G 3/3688 345/209
2016/0335942 A1* 11/2016 Cho ..... G09G 3/2007
2016/0379581 A1* 12/2016 Takenaka ..... G09G 3/3648 345/212
2017/0038873 A1* 2/2017 Shang ..... G06F 3/044
2017/0154595 A1* 6/2017 Kang ..... G09G 3/3677
2017/0169753 A1* 6/2017 Hao ..... G09G 3/2018
2017/0186391 A1* 6/2017 Ochiai ..... G09G 3/3655
2018/0096646 A1* 4/2018 Zeng ..... G09G 3/2096
2019/0081471 A1* 3/2019 Park ..... H02H 3/08
2019/0121476 A1* 4/2019 Jang ..... G06F 3/0412
2019/0197959 A1* 6/2019 Noh ..... G09G 3/3258
2019/0197979 A1* 6/2019 Kim ..... G09G 3/2092
2019/0206348 A1* 7/2019 Ahn ..... G09G 3/3614

* cited by examiner

DISPLAY DEVICE AND INTERFACE METHOD THEREOF

CROSS-REFERENCE TO RELATED APPLICATION(S)

This application claims the benefit of Korean Patent Application No. 10-2017-0163386, filed Nov. 30, 2017, which is hereby incorporated by reference as if fully set forth herein.

BACKGROUND

Technical Field

The present disclosure relates to a display device capable of reducing the number of transmission lines by enabling a master circuit to perform communication with a plurality of slave circuits, which utilize different interfaces, through a common transmission line in a time divisional manner, and an interface method thereof.

Description of the Related Art

Representative examples of a display device for displaying an image using digital data include a liquid crystal display (LCD) using liquid crystal, an organic light emitting diode (OLED) display using an OLED, and an electrophoretic display (EPD) using electrophoretic particles.

A display device includes a panel for displaying an image through a pixel array, gate and data drivers for driving the panel, a timing controller, and a gamma voltage generator.

The gate driver may be formed on a substrate along with a thin film transistor (TFT) array of the pixel array and may be mounted in the panel as a gate in panel (GIP) type. The gate driver receives a plurality of gate control signals from a level shifter controlled by the timing controller.

The timing controller transmits gamma data to the gamma voltage generator using an inter-integrated circuit ($I^2C$) interface. The timing controller transmits a plurality of timing control signals necessary to drive the level shifter to the level shifter using a simple interface. The level shifter and the gamma voltage generator are mounted on a control printed circuit board (PCB) along with the timing controller.

Since the timing controller corresponding to the master circuit communicates with the gamma voltage generator and the level shifter corresponding to slave circuits using different interfaces, transmission lines between the timing controller and the gamma voltage generator and transmission lines between the timing controller and the level shifter are required. To this end, the number of output pins of the timing controller is increased and the number of wirings of the control PCB is increased, thereby increasing costs and reducing transmission efficiency.

BRIEF SUMMARY

Accordingly, the present disclosure is directed to a display device and an interface method thereof that substantially obviate one or more problems due to limitations and disadvantages of the related art.

In various embodiments, the present disclosure provides a display device capable of reducing the number of transmission lines by enabling a master circuit to perform communication with a plurality of slave circuits, which utilize different interfaces, through a common transmission line in a time divisional manner, and an interface method thereof.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a display device includes a timing controller, a gamma voltage generator connected to the timing controller through a common transmission line to perform communication using a first interface in a first interface enable period and a level shifter connected to the timing controller through the common transmission line to perform communication using a second interface in a second interface enable period different from the first interface enable period.

According to another aspect of the present disclosure, an interface method of a display device includes a timing controller performing, through a first interface, communication with a gamma voltage generator connected through a common transmission line in a first interface enable period to transmit gamma data, and the timing controller performing, through a second interface, communication with a level shifter connected through the common transmission line in a second interface enable period to transmit a plurality of control signals.

In the first interface enable period, the timing controller may output gamma data output from a first transmitter using an $I^2C$ interface corresponding to the first interface to the common transmission line, a first receiver of the gamma voltage generator using the first interface may be enabled to receive the gamma data transmitted through the common transmission line and to generate and output a plurality of reference gamma voltages, and a second receiver of the level shifter may be disabled.

In the second interface enable period, the timing controller may output a plurality of control signals output from a second transmitter using a simple interface corresponding to the second interface to the common transmission line, the first receiver of the gamma voltage generator may be disabled, and the second receiver of the level shifter using the second interface may be enabled to receive the plurality of control signals transmitted through the common transmission line and to generate and output a plurality of gate control signals.

The timing controller, the gamma voltage generator and the level shifter may use a first period when the analog driving voltage is supplied and the gate high voltage is not supplied as the first interface enable period and use a second period when the analog driving voltage and the gate high voltage are supplied as the second interface enable period.

The timing controller, the gamma voltage generator and the level shifter may detect a vertical blank period of each frame using at least one of a vertical synchronization signal, a start pulse and a reset pulse, use the vertical blank period as the first interface enable period and use an active period other than the vertical blank period as the second interface enable period.

The timing controller, the gamma voltage generator and the level shifter may detect a communication frequency of the first interface and a communication frequency of the second interface, use a first period in which the detected communication frequency is greater than a first reference value and is less than a second reference value as the first interface enable period, and use a second period in which the detected communication frequency is greater than the second reference value as the second interface enable period.

The display device may further include a panel, a gate driver mounted in the panel, a plurality of chips on film (COFs) connected between the panel and a source printed circuit board (PCB) and having a plurality of data integrated circuits (ICs) mounted thereon, and a control PCB connected to the source PCB through a flexible cable and having the timing controller mounted thereon. The gamma voltage generator may be mounted on the source PCB and connected to the plurality of data ICs. The level shifter may be mounted on the source PCB and connected to the gate driver through any one COF, which is close to the gate driver, of the plurality of COFs. The common transmission line connected to the timing controller may be connected to the gamma voltage generator and the level shifter through the control PCB, the flexible cable and the source PCB.

The gamma voltage generator and the level shifter may be configured as individual ICs or a unified IC.

It is to be understood that both the foregoing general description and the following detailed description of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Hereinafter, exemplary embodiments of the present disclosure will be described with reference to the accompanying drawings.

Figure 1:
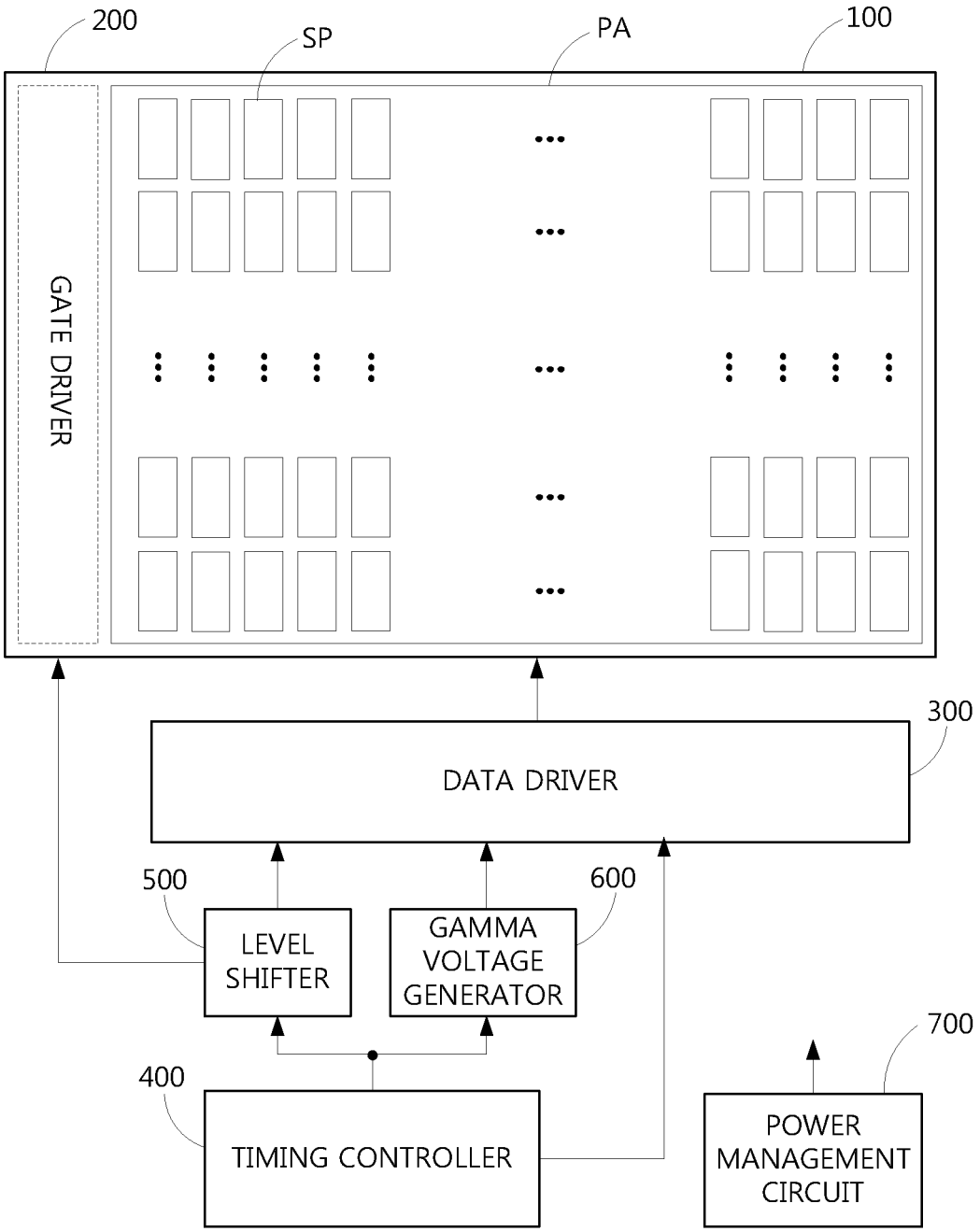
FIG. 1 is a schematic block diagram showing the configuration of a display device according to an embodiment of the present disclosure.

FIG. 1 is a schematic block diagram showing the configuration of a display device according to an embodiment of the present disclosure.

Referring to FIG. 1, the display device includes a panel 100, a GIP type gate driver 200, a data driver 300, a timing controller 400, a level shifter 500, a gamma voltage generator 600 and a power management circuit 700.

The power management circuit 700 generates and outputs various types of driving voltages necessary for operation of all circuit components of the display device, such as the panel 100, the gate driver 200, the data driver 300, the timing controller 400, the gamma voltage generator 600 and the level shifter 500, using an external input voltage. For example, the power management circuit 700 generates and outputs a digital block driving voltage VCC supplied to the timing controller 400, the data driver 300 and the level shifter 500, an analog block driving voltage VDD supplied to the data driver 300, a gate on voltage VGH and a gate off voltage VGL supplied to the gate driver 200 and the level shifter 500, and a driving voltage necessary to drive the panel 100, using the input voltage.

The panel 100 displays an image through a pixel array PA in which subpixels SP are arranged in a matrix. A basic pixel may be composed of at least three subpixels, which may express white by mixing colors, among white (W), red (R), green (G) and blue (B) subpixels. For example, the basic pixel may be composed of R/G/B subpixels or W/R/G/B subpixels. The basic pixel may be composed of R/G/B subpixels, W/R/G subpixels, B/W/R subpixels or G/B/W subpixels.

The panel 100 may include various display panels such as an LCD panel and an OLED panel and may be a display panel having a touch sensing function.

The gate driver 200 is formed on a substrate along with a TFT array configuring a pixel array PA of the panel 100 and is mounted at one side or both sides of the panel 100 as a GIP type. The gate driver 200 receives a plurality of gate control signals from the level shifter 500 to perform a shift operation, thereby individually driving the gate lines of the panel 100. The gate driver 200 supplies a scan signal of a gate on voltage (gate high voltage) VGH to a corresponding gate line in a driving period of the corresponding gate line and supplies a gate off voltage (gate low voltage) VGL to a corresponding gate line in a non-driving period of the corresponding gate line.

The data driver 300 receives a plurality of data control signals and image data from the timing controller 400, latches the image data, converts the latched image data into an analog data signal, and supplies the analog data signal to the data lines of the panel 100. The data driver 300 receives a plurality of reference gamma voltages from the gamma voltage generator 600 and divides the plurality of reference gamma voltages into a plurality of grayscale voltages corresponding to grayscale values of data. The data driver 300 converts digital data into an analog data voltage using the divided grayscale voltages and supplies the data voltage to each of the data lines of the panel 100.

The gamma voltage generator 600 generates and supplies the plurality of reference gamma voltages corresponding to the gamma characteristics of the display device to the data driver 300 under control of the timing controller 400. The gamma voltage generator 600 may include a programmable gamma IC, receive gamma data from the timing controller 400 through a first interface, e.g., an $I^2C$ interface, generate a reference gamma voltage or adjust the level of the reference gamma voltage according to the gamma data, and output the reference gamma voltage.

The level shifter 500 generates and outputs a plurality of gate control signals to the gate driver 200 under control of the timing controller 400. The level shifter 500 receives a plurality of control signals from the timing controller 400 through a second interface, e.g., a simple interface, performs logic processing and level shifting, and generates and outputs the plurality of gate control signals.

For example, the level shifter 500 shifts the levels of a start pulse VST and a reset pulse RST received from the timing controller 400, and outputs the start pulse and the reset pulse, the levels of which are shifted. The level shifter 500 performs logic processing with respect to an ON clock and an OFF clock received from the timing controller 400, generates a plurality of scan clocks used in the gate driver 200 as scan signals, and outputs the plurality of scan clocks, the levels of which are shifted. The level shifter 500 may further receive second ON and OFF clocks from the timing controller 400 and further generate and output a plurality of carry clocks for controlling shift operation of the gate driver 200. If the panel 100 is an OLED panel, the level shifter 500 may further receive third ON and OFF clocks from the timing controller 400 and further generate and output a plurality of sense clocks used as sense signals for driving sensing gate lines in the gate driver 200.

The timing controller 400 receives image data and input timing control signals from an external host system. The host system may be any one of a computer, a TV system, a set-top box and a system of a portable terminal such as a tablet or a mobile phone. The input timing control signals include a dot clock, a data enable signal, a vertical synchronization signal and a horizontal synchronization signal.

The timing controller 400 generates and supplies a plurality of data control signals for controlling driving timings of the data driver 300 to the data driver 300 using timing setting information stored along with the input timing control signals. The timing controller 400 performs a variety of image processing such as luminance correction for reducing power consumption and image quality correction with respect to the image data and supplies the data subjected to image processing to the data driver 300. The timing controller 400 may serially insert clocks into transmitted data such as the image data or the data control data and transmit the data to the data driver 300 using a high-speed serial interface for performing serial transmission. Examples of the high-speed serial interface include an embedded point-to-point interface (EPI).

The timing controller 400 generates and supplies gamma data according to the gamma characteristics of the display device to the gamma voltage generator 600. The timing controller 400 may control a gamma characteristic curve when a frame frequency, an image mode, image characteristics, etc., are changed and generate and supply gamma data according to the controlled gamma characteristic curve to the gamma voltage generator 600.

In particular, the timing controller 400 corresponding to a master circuit may dividedly perform communication with the gamma voltage generator 600 and the level shifter 500 corresponding to a plurality of slave circuits, which utilize different interfaces, through a common transmission line in a time divisional manner, thereby reducing the number of output pins of the timing controller and the number of transmission lines. This will be described in detail below.

Meanwhile, when the panel 100 is an OLED panel, the data driver 300 may further include a sensing unit for sensing pixel current indicating the electrical properties (the threshold voltage and mobility of a driving TFT, the threshold voltage of an OLED device, etc.) of each subpixel as current or a voltage, converting the pixel current into digital sensing data, and supplying the digital sensing data to the timing controller 400 under control of the timing controller 400. The timing controller 400 updates a compensation value of each subpixel using the sensing data of each subpixel received from the data driver 300. The timing controller 400 may apply the compensation value to the image data corresponding to each subpixel, thereby compensating for luminance unevenness due to a difference in properties between subpixels.

Figure 2A:
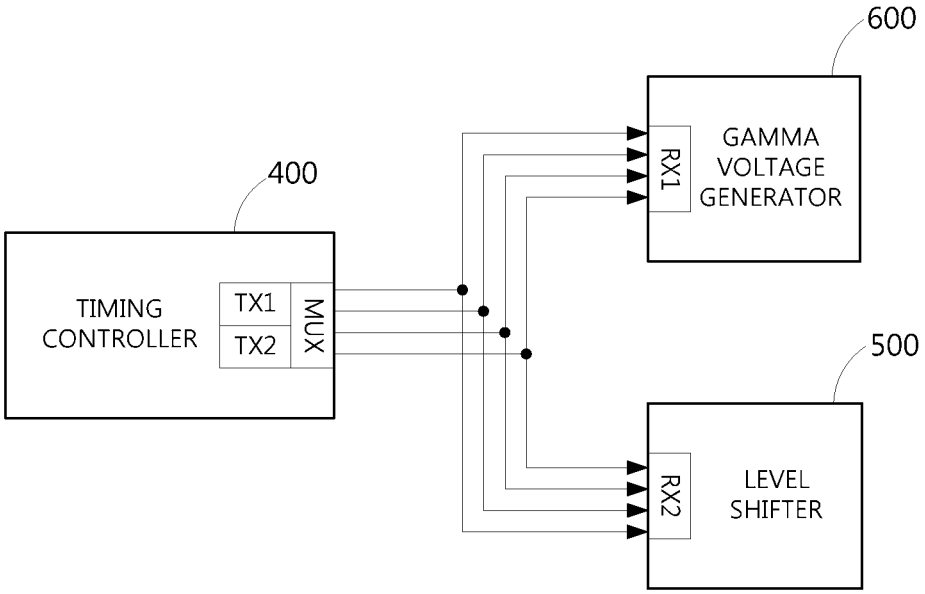
FIGS. 2A and 2B are block diagrams showing a connection relation between a timing controller and a gamma voltage generator or a level shifter according to an embodiment of the present disclosure.
Figure 2B:
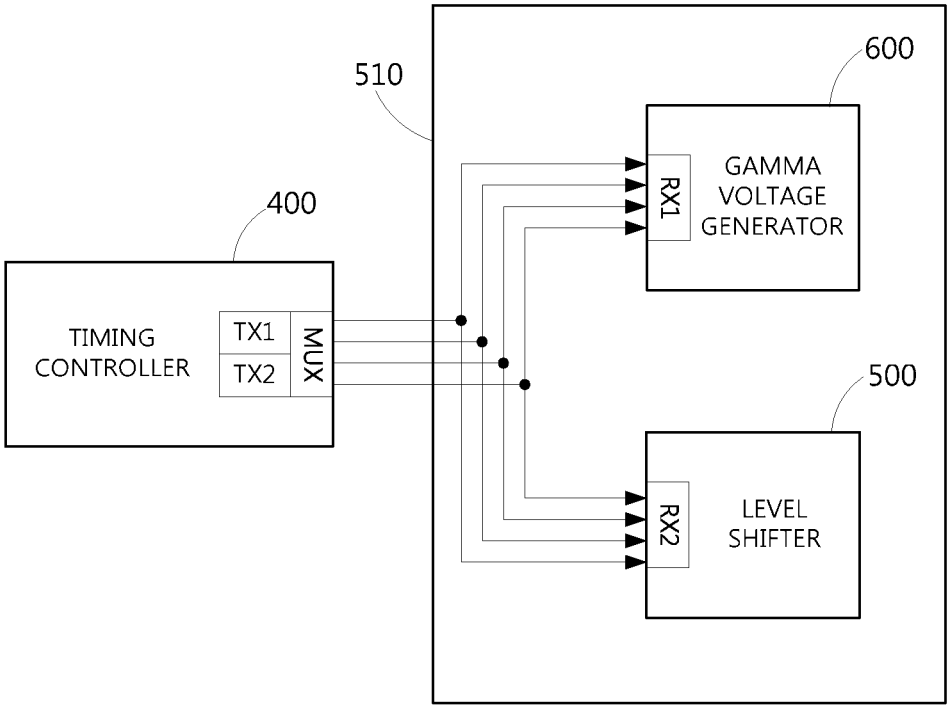

FIGS. 2A and 2B are block diagrams showing a connection relation between a timing controller and a gamma voltage generator or a level shifter according to an embodiment of the present disclosure.

Referring to FIGS. 2A and 2B, the timing controller 400 is connected to the gamma voltage generator 600 and the level shifter 500 through a common transmission line. The timing controller 400, the gamma voltage generator 600 and the level shifter 500 shown in FIG. 2A may be configured as individual ICs. Alternatively, as shown in FIG. 2B, the gamma voltage generator 600 and the level shifter 500 may be configured as a unified IC 510.

The timing controller 400 and the gamma voltage generator 600 include a first transmitter TX1 and a first receiver RX1 which perform communication through the common transmission line using a first interface, that is, an $I^2C$ interface, respectively. The timing controller 400 and the level shifter 500 include a second transmitter TX2 and a second receiver RX2 which perform communication through the common transmission line using a second interface, that is, a simple interface, respectively. The timing controller 400 further includes a multiplexer MUX for selecting and outputting the outputs of the first and second transmitters TX1 and TX2 in a time divisional manner to the common transmission channel.

The timing controller 400 outputs the gamma data which is the output of the first transmitter TX1 using the I2C interface to the common transmission line in a first interface enable period and outputs plural control signals which are the output of the second transmitter TX2 using the simple interface to the common transmission line in a second interface enable period different from the first interface enable period.

The gamma voltage generator 600 receives the gamma data transmitted through the common transmission line in the first interface enable period and generates a plurality of reference gamma voltages.

The level shifter 500 receives the plurality of control signals transmitted through the common transmission line in the second interface enable period and generates a plurality of gate control signals.

The timing controller 400, the gamma voltage generator 600 and the level shifter 500 may dividedly perform communication in the first interface enable period and the second interface enable period using mediator signals.

Figure 3:
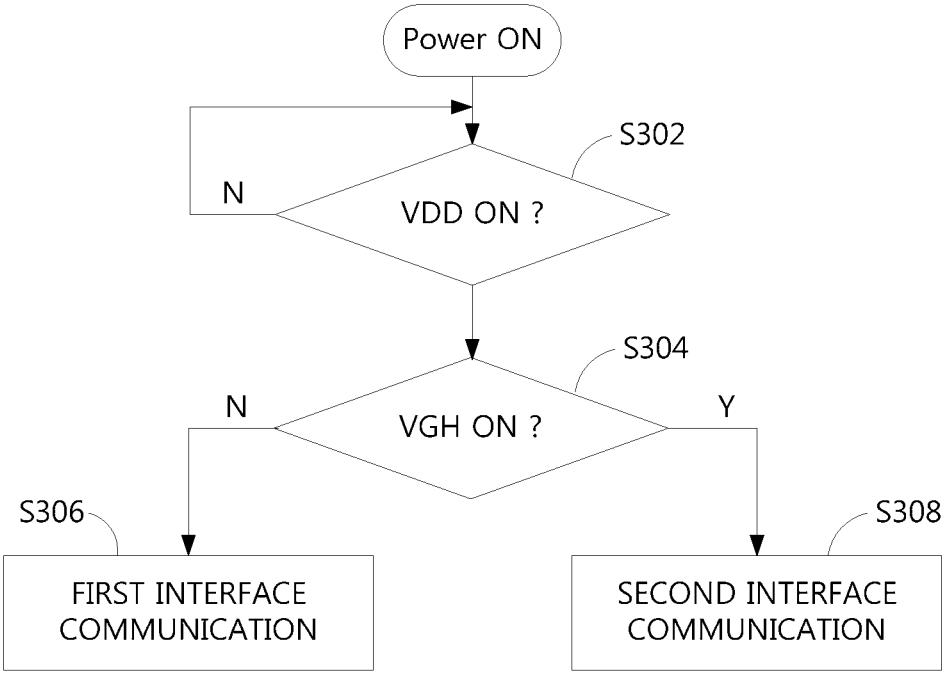
FIG. 3 is a flowchart illustrating a method of distinguishing between interfaces of a display device according to a first embodiment of the present disclosure.
Figure 4:
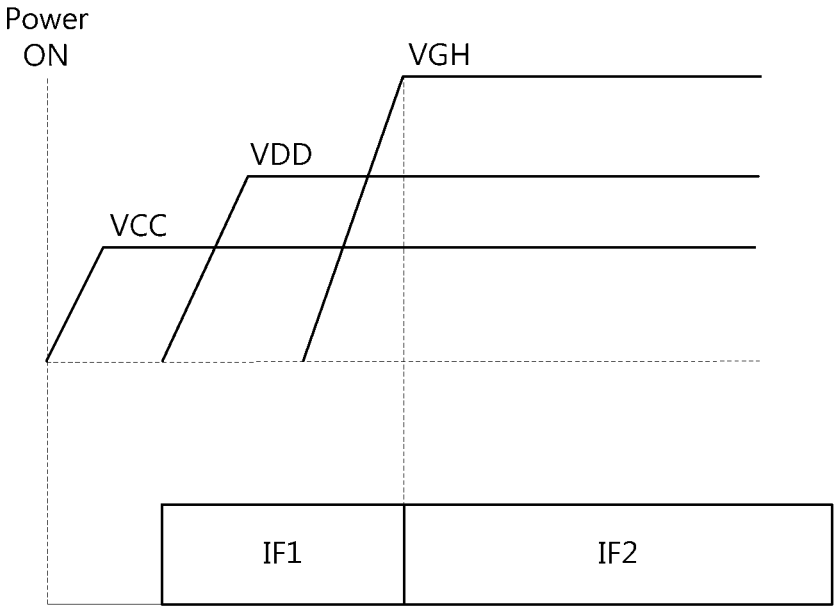
FIG. 4 is a timing chart illustrating a method of distinguishing between interfaces of a display device according to a first embodiment of the present disclosure.
Figure 5:
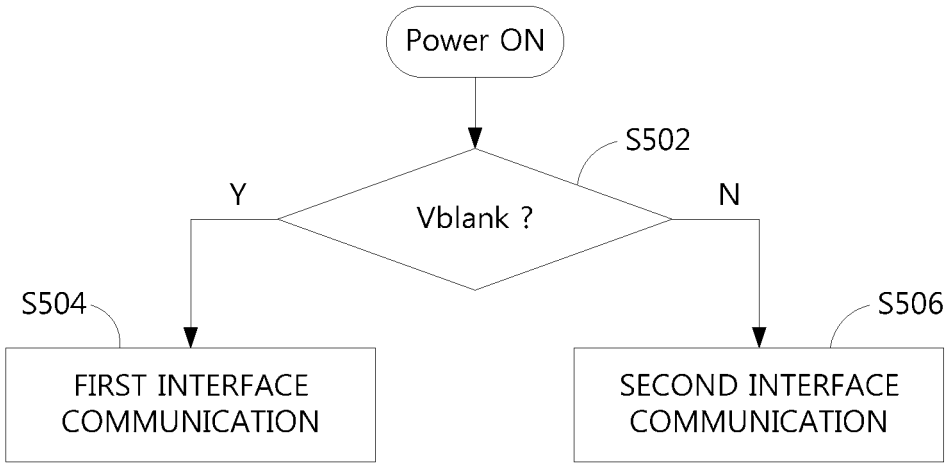
FIG. 5 is a flowchart illustrating a method of distinguishing between interfaces of a display device according to a second embodiment of the present disclosure.
Figure 6:
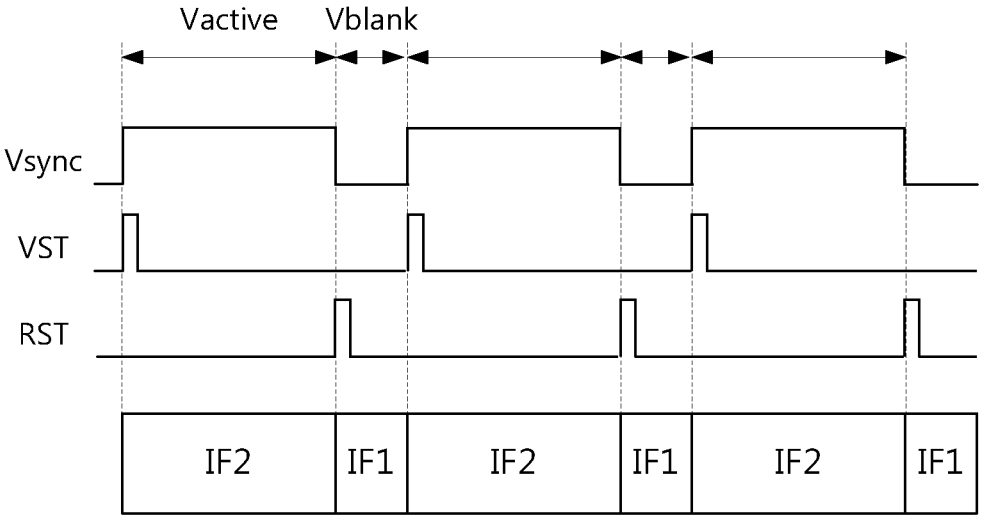
FIG. 6 is a timing chart illustrating a method of distinguishing between interfaces of a display device according to a second embodiment of the present disclosure.
Figure 7:
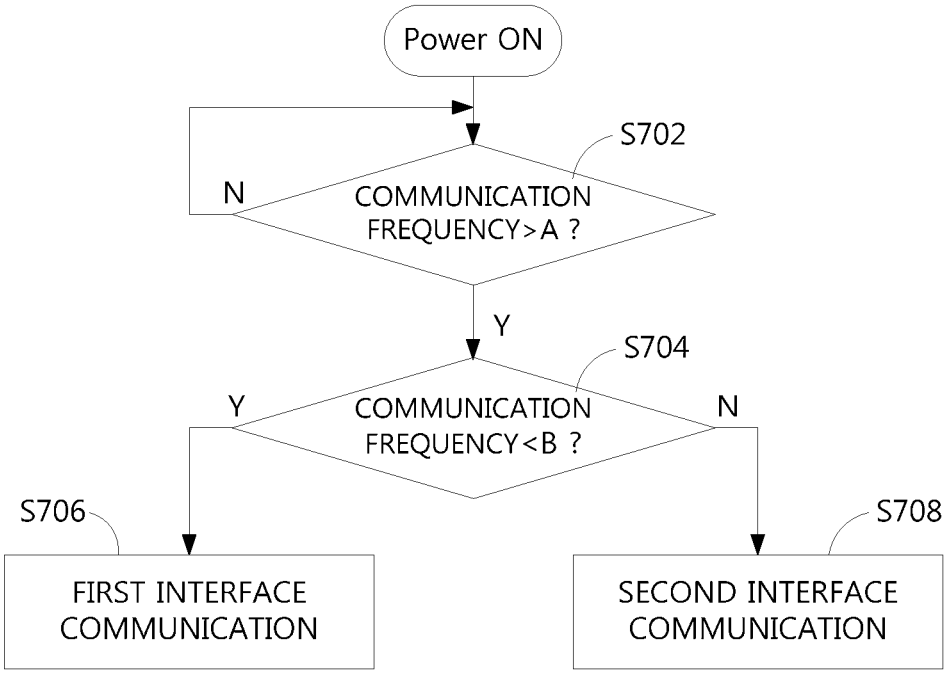
FIG. 7 is a flowchart illustrating a method of distinguishing between interfaces of a display device according to a third embodiment of the present disclosure.
Figure 8:
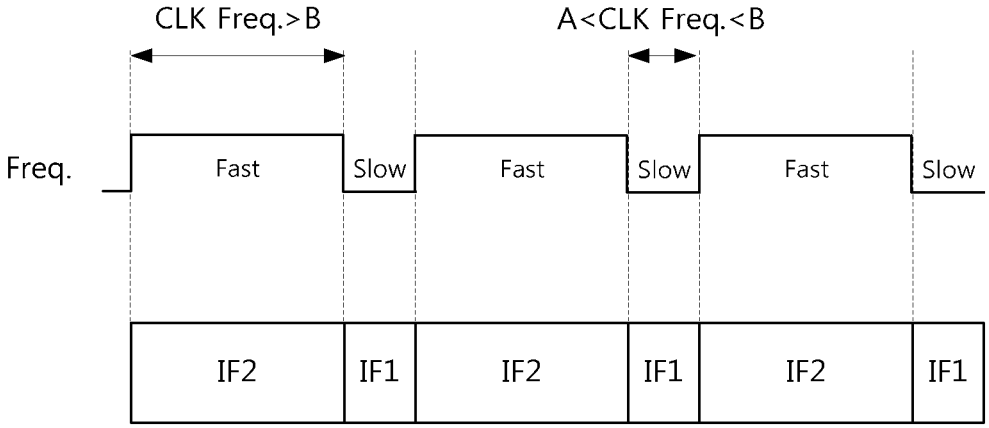
FIG. 8 is a timing chart illustrating a method of distinguishing between interfaces of a display device according to a third embodiment of the present disclosure.

For example, the method of distinguishing between the first interface enable period and the second interface enable period may include a method of using a power sequence as shown in FIGS. 3 and 4, a method of using a blank period of each frame as shown in FIGS. 5 and 6, and a method of using the levels of communication frequencies of the first and second interfaces as shown in FIGS. 7 and 8.

In the first interface enable period IF1, the timing controller 400 transmits a first interface output to the common transmission channel, the gamma voltage generator 600 is enabled for communication to receive the gamma data output from the timing controller 400, and the level shifter 500 is disabled for communication.

In the second interface enable period IF2, the timing controller 400 transmits a second interface output to the common transmission channel, the gamma voltage generator 600 is disabled for communication, and the level shifter 500 is enabled for communication to receive the plurality of control signals from the timing controller 400.

FIGS. 3 and 4 are a flowchart and a timing chart illustrating a method of distinguishing between interfaces of a display device according to a first embodiment of the present disclosure, respectively.

Referring to FIGS. 3 and 4, when power is turned on, the timing controller 400, the gamma voltage generator 600 and the level shifter 500 detect a power sequence received from the power management circuit 700 (FIG. 1) to distinguish between the first and second interface enable periods IF1 and IF2.

The timing controller 400, the gamma voltage generator 600 and the level shifter 500 define a first period when an analog driving voltage VDD is supplied (S302, Y) and a gate high voltage VGH is not supplied (S304, N) as the first interface enable period IF1 to perform communication (S306). The timing controller 400, the gamma voltage generator 600 and the level shifter 500 define a second period when the analog driving voltage VDD is supplied (S302, Y) and the gate high voltage VGH is supplied (S304, Y) as the second interface enable period IF2 to perform communication (S308).

FIGS. 5 and 6 are a flowchart and a timing chart illustrating a method of distinguishing between interfaces of a display device according to a second embodiment of the present disclosure, respectively.

Referring to FIGS. 5 and 6, when power is turned on, the timing controller 400, the gamma voltage generator 600 and the level shifter 500 detect a vertical blank period Vblank of each frame to respectively define the vertical blank period Vblank and an active period Vactive as the first interface enable period IF1 and the second interface enable period IF2. The vertical blank period Vblank may be detected using the vertical synchronization signal as shown in FIG. 6 or using the start pulse VST and the reset pulse RST respectively indicating starting timing and end timing of the active period Vactive.

The timing controller 400, the gamma voltage generator 600 and the level shifter 500 define the first interface enable period IF1 to perform communication (S504), when the vertical blank period Vblank is detected (S502, Y). The timing controller 400, the gamma voltage generator 600 and the level shifter 500 define the second interface enable period IF2 to perform communication (S506), when the vertical blank period Vblank is not detected, that is, when the active period Vactive is detected (S502, N).

FIGS. 7 and 8 are a flowchart and a timing chart illustrating a method of distinguishing between interfaces of a display device according to a third embodiment of the present disclosure, respectively.

Referring to FIGS. 7 and 8, when power is turned on, the timing controller 400, the gamma voltage generator 600 and the level shifter 500 detect the communication frequencies of the first and second interfaces and distinguish between the first interface enable period IF1 and the second interface enable period IF2 according to the level of the communication frequency.

For example, since first interface communication for transmitting the gamma data uses a clock frequency of several hundred Hz and second interface communication for transmitting the control signals for the level shifter uses a clock frequency of several tens of MHz, the communication frequency of the second interface is higher than that of the first interface.

The timing controller 400, the gamma voltage generator 600 and the level shifter 500 may count clocks transmitted and received through the common transmission channel to detect the clock frequency, thereby distinguishing between the first interface having the relatively low communication frequency and the second interface having the relatively high communication frequency.

The timing controller 400, the gamma voltage generator 600 and the level shifter 500 define the first interface enable period IF1 to perform communication (S706), when the clock frequency is greater than a first reference value A (S702, Y) and is less than a second reference value B (S704, Y). The timing controller 400, the gamma voltage generator 600 and the level shifter 500 define the second interface enable period IF2 to perform communication (S708), when the clock frequency is greater than the first reference value A (S702, Y) and is greater than the second reference value B (S704, N). The first reference value A is set to be less than the second reference value B.

Figure 9:
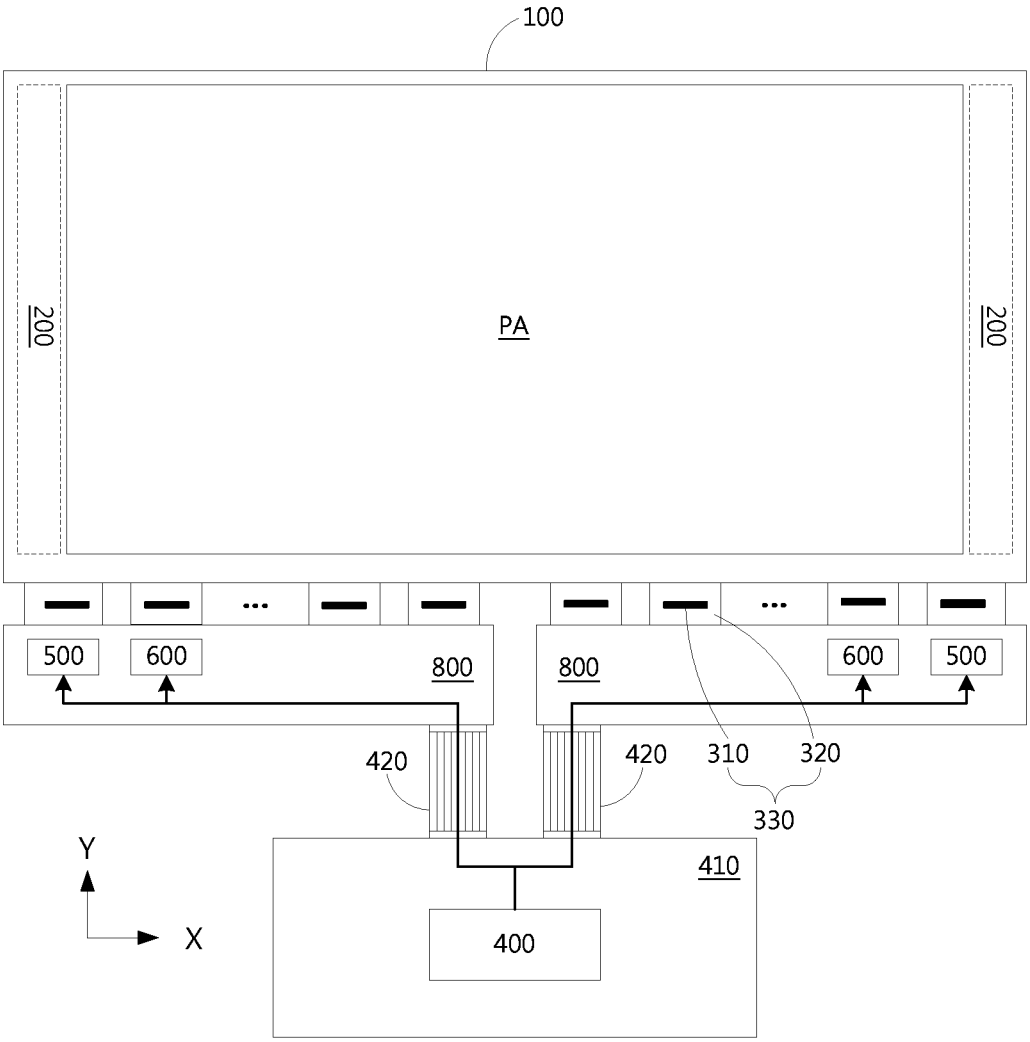
FIG. 9 is a schematic system diagram showing the configuration of a display device according to an embodiment of the present disclosure.

FIG. 9 is a schematic system diagram showing the configuration of a display device according to an embodiment of the present disclosure.

Referring to FIG. 9, the timing controller 400 and the power management circuit 700 (FIG. 1) are configured as individual ICs and are mounted on a control PCB 410 and the level shifter 500 and the gamma voltage generator 600 are configured as individual ICs or a unified IC and are mounted on a source PCB 800. The FFC 420 is connected to the control PCB 410 and the source PCB 800 through connectors. One or a plurality of source PCBs 800 is provided according to the size of the panel 100. Each of the plurality of source PCBs 800 is connected to the control PCB 410 through each of a plurality of FFCs 420 located inward in an X-axis direction.

The data driver 300 (FIG. 1) includes a plurality of data ICs 310 for divisionally driving the data lines of the pixel array PA and the plurality of data ICs 310 is individually mounted on each circuit film 320 such as a chip on film (COF) 330. The plurality of COFs 320, on which the data ICs 310 are respectively mounted, is bonded to the panel 100 and the source PCB 800 through an anisotropic conductive film (ACF) in a tape automated bonding (TAB) manner and is located between the panel 100 and the source PCB 800.

The level shifter 500 and the gamma voltage generator 600 are mounted on the source PCB 800 close to the gate driver 200. The plurality of level shifters 500 is mounted on the plurality of source PCBs 800 at a position close to the gate driver 200 in the X-axis direction and the plurality of gamma voltage generators 600 is mounted on the source PCB 800 at a position close to the level shifter 500. For example, a level shifter 500 of the plurality of level shifters may be mounted to the source PCB 800 at a mounting position that is closest to a connection element of a gate driver 200, and a gamma voltage generator 600 of the plurality of gamma voltage generators may be mounted to the source PCB 800 at a mounting position closest to the level shifter 500 closest to the gate driver 200. The level shifters 500 supply the plurality of gate control signals to the gate drivers 200 through the COFs 320 close to the gate drivers 200.

The pair of gate drivers 200 disposed at both sides of the panel 100 simultaneously supplies scan signals at both ends of the gate lines, thereby reducing delay of the scan signals as compared to the case where the scan signal is supplied at one end of each gate line.

As described above, the timing controller 400 dividedly performs communication with the gamma voltage generator 600 and the level shifter 500 through the common transmission line in the first interface enable period IF1 and the second interface enable period IF2 in a time divisional manner. Therefore, it is possible to reduce the number of output pins of the timing controller 400 and the number of transmission lines passing through the control PCB 410, the FFC 420 and the source PCB 800.

The gamma voltage generator 600 and the level shifter 500 are mounted on the source PCB 800, thereby reducing the number of transmission lines passing through the control PCB 410, the FFC 420 and the source PCB 800, as compared to the case where the gamma voltage generator 600 and the level shifter 500 are mounted on the control PCB.

As a result, it is possible to reduce costs and to improve data transmission efficiency.

The display device according to an embodiment is applicable to all display devices such as an OLED display device and an LCD.

In a display device according to an embodiment, a master circuit (a timing controller) performs communication with a plurality of slave circuits (a level shifter and a gamma voltage generator), which utilize different interfaces, through a common transmission line in a time divisional manner, thereby reducing the number of output pins of the timing controller and the number of transmission lines. As a result, it is possible to reduce costs and to improve data transmission efficiency.

In the display device according to the embodiment, the level shifter and the gamma voltage generator are mounted on a source PCB, thereby further reducing the number of transmission lines connected between a control PCB and the source PCB through an FFC and reducing the sizes of the control PCB, the FFC and the source PCB. As a result, it is possible to reduce costs.

The display device according to the embodiment is applicable to all display devices such as an OLED display device and an LCD display device.

The foregoing description is merely illustrative of the present disclosure, and various modifications may be made by those skilled in the art without departing from the spirit of the present disclosure. Therefore, the embodiments disclosed in the specification do not limit the present disclosure. It is intended that the scope of the disclosure should be interpreted by the claims appended hereto, and that all techniques within the scope of equivalents thereof should be construed as being within the scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a timing controller including a first transmitter;

a gamma voltage generator including a first receiver, the gamma voltage generator connected to the timing controller through a common transmission line to communicate using a first interface in a first interface enable mode; and a level shifter including a second receiver, the level shifter connected to the timing controller through the common transmission line to communicate using a second interface in a second interface enable mode different from the first interface enable mode, wherein in the first interface enable mode:

the timing controller outputs gamma data to the common transmission line from the first transmitter using an inter-integrated circuit ($I^2C$) interface corresponding to the first interface;

the first receiver of the gamma voltage generator is enabled to receive, using the $I^2C$ interface, the gamma data transmitted through the common transmission line;

the gamma voltage generator is enabled to output a plurality of reference gamma voltages; and the second receiver of the level shifter is disabled.

2. The display device according to claim 1, wherein the timing controller further includes a second transmitter, and in the second interface enable mode:

the timing controller outputs a plurality of control signals to the common transmission line from the second transmitter using a simple interface corresponding to the second interface;

the first receiver of the gamma voltage generator is disabled;

the second receiver of the level shifter is enabled to receive, using the second interface, the plurality of control signals transmitted through the common transmission line; and the level shifter is enabled to output a plurality of gate control signals.

3. The display device according to claim 2, the display device further comprising:

a power management circuit selectively providing a gate high voltage and an analog driving voltage, wherein the timing controller, the gamma voltage generator, and the level shifter communicate in the first interface enable mode and the second interface enable mode using a supply sequence of the gate high voltage and the analog driving voltage.

4. The display device according to claim 3, wherein the timing controller, the gamma voltage generator, and the level shifter:

operate according to the first interface enable mode during a first period in which the analog driving voltage is supplied and the gate high voltage is not supplied; and operate according to the second interface enable mode during a second period in which the analog driving voltage and the gate high voltage are supplied.

5. The display device according to claim 2, wherein the timing controller, the gamma voltage generator and the level shifter:

detect a vertical blank period of each frame using at least one of a vertical synchronization signal, a start pulse, and a reset pulse;

operate according to the first interface enable mode during the vertical blank period; and operate according to the second interface enable mode during an active period other than the vertical blank period.

6. The display device according to claim 2, wherein at least one of the timing controller, the gamma voltage generator, and the level shifter detect a communication frequency on the common transmission line, and operate according to the first interface enable mode or the second interface enable mode based at least in part on the communication frequency detected.

7. The display device according to claim 6, wherein the timing controller, the gamma voltage generator, and the level shifter:

operate according to the first interface enable mode during a first period in which the detected communication frequency is greater than a first reference value and is less than a second reference value; and operate according to the second interface enable mode during a second period in which the detected communication frequency is greater than the second reference value.

8. The display device according to claim 1, further comprising:

a panel;

a gate driver mounted in the panel;

a source printed circuit board (PCB);

a plurality of chips on film (COFs) connected between the panel and the source printed circuit board, the plurality of COFs having a plurality of data integrated circuits (ICs) mounted thereon; and a control PCB connected to the source PCB through a flexible cable and having the timing controller mounted thereon, wherein the gamma voltage generator is mounted on the source PCB and is connected to the plurality of data ICs, wherein the level shifter is mounted on the source PCB and is connected to the gate driver through a COF of the plurality of COFs, the connected COF being a COF close to the gate driver, and wherein the common transmission line connected to the timing controller is connected to the gamma voltage generator and the level shifter through the control PCB, the flexible cable, and the source PCB.

9. The display device according to claim 8, wherein the gamma voltage generator and the level shifter are individual ICs or a unified IC.

10. An interface method of a display device, the interface method comprising:

communicating, by a timing controller using a first interface, with a gamma voltage generator connected through a common transmission line in a first interface enable mode to transmit gamma data; and communicating, by the timing controller using a second interface, with a level shifter connected through the common transmission line in a second interface enable mode to transmit a plurality of control signals, wherein communicating in the first interface enable mode includes:

enabling, using the first interface, a first receiver of the gamma voltage generator to receive the gamma data transmitted through the common transmission line;

enabling the gamma voltage generator to output a plurality of reference gamma voltages; and disabling a second receiver of the level shifter.

11. The interface method according to claim 10, wherein communicating in the second interface enable mode includes:

disabling the first receiver of the gamma voltage generator;

enabling, using the second interface, the second receiver of the level shifter to receive the plurality of control signals transmitted through the common transmission line; and enabling the level shifter to output a plurality of gate control signals.

12. The interface method according to claim 11, wherein communicating in the first interface enable mode includes communicating during a first period in which an analog driving voltage is supplied and a gate high voltage is not supplied; and communicating in the second interface enable mode includes communicating during a second period in which the analog driving voltage and the gate high voltage are supplied.

13. The interface method according to claim 11, further comprising:

detecting, by one or more of the timing controller, the gamma voltage generator and the level shifter, a vertical blank period of each frame using at least one of a vertical synchronization signal, a start pulse, and a reset pulse, wherein communicating in the first interface enable mode is during the vertical blank period, and communicating in the second interface enable mode is during an active period other than the vertical blank period.

14. The interface method according to claim 11, further comprising:

detecting a communication frequency on the common transmission line;

operating according to the first interface enable mode during a first period in which the detected communication frequency is greater than a first reference value and is less than a second reference value; and operating according to the second interface enable mode during a second period in which the detected communication frequency is greater than the second reference value.

15. A display device, comprising:

a timing controller;

a gamma voltage generator;

a level shifter; and a common transmission line connecting the timing controller, the gamma voltage generator, and the level shifter, the common transmission line having a first branch line and a second branch line, wherein the common transmission line extends from the timing controller and branches out to connect to the gamma voltage via the first branch line, and the common transmission line extends from the timing controller and branches out to connect to the level shifter via the second branch line, wherein the gamma voltage generator communicates with the timing controller through the first branch line of the common transmission line using a first interface in a first interface enable mode; and wherein the level shifter communicates with the timing controller through the second branch line of the common transmission line using a second interface in a second interface enable mode different from the first interface enable mode.

16. The display device according to claim 15, wherein the timing controller includes a first transmitter, the gamma voltage generator includes a first receiver, and the level shifter includes a second receiver, and in the first interface enable mode:

the timing controller outputs gamma data to the first branch line of the common transmission line from the first transmitter using an inter-integrated circuit ($I^2C$) interface corresponding to the first interface;

the first receiver of the gamma voltage generator is enabled to receive, using the $I^2C$ interface, the gamma data transmitted through the common transmission line;

the gamma voltage generator is enabled to output a plurality of reference gamma voltages; and the second receiver of the level shifter is disabled.

17. The display device according to claim 16, wherein the timing controller further includes a second transmitter, and in the second interface enable mode:

the timing controller outputs a plurality of control signals to the second branch line of the common transmission line from the second transmitter to the second interface;

the first receiver of the gamma voltage generator is disabled;

the second receiver of the level shifter is enabled to receive, using the second interface, the plurality of control signals transmitted through the common transmission line; and the level shifter is enabled to output a plurality of gate control signals.

18. The display device according to claim 17, the display device further comprising:

a power management circuit selectively providing a gate high voltage and an analog driving voltage, wherein the timing controller, the gamma voltage generator, and the level shifter communicate in the first interface enable mode and the second interface enable mode using a supply sequence of the gate high voltage and the analog driving voltage.

19. The display device according to claim 18, wherein the timing controller, the gamma voltage generator, and the level shifter:

operate according to the first interface enable mode during a first period in which the analog driving voltage is supplied and the gate high voltage is not supplied; and operate according to the second interface enable mode during a second period in which the analog driving voltage and the gate high voltage are supplied.

20. The display device according to claim 15, further comprising:

a panel;

a gate driver mounted in the panel;

a source printed circuit board (PCB);

a plurality of chips on film (COFs) connected between the panel and the source printed circuit board, the plurality of COFs having a plurality of data integrated circuits (ICs) mounted thereon; and a control PCB connected to the source PCB through a flexible cable and having the timing controller mounted thereon, wherein the gamma voltage generator is mounted on the source PCB and is connected to the plurality of data ICs, wherein the level shifter is mounted on the source PCB and is connected to the gate driver through a COF of the plurality of COFs, the connected COF being a COF close to the gate driver, and wherein the common transmission line connected to the timing controller is connected to the gamma voltage generator and the level shifter through the control PCB, the flexible cable, and the source PCB.

* * * * *